US005560069A

United States Patent [19]

Berger et al.

[11] Patent Number: 5,560,069

[45] Date of Patent: Oct. 1, 1996

[54] LINT BRUSH FOR A DRYER DUCT

[76] Inventors: Linnea J. Berger; Thomas J. Berger, both of 103 Burlington Beach Rd., Valparaiso, Ind. 46383

[21] Appl. No.: 494,960

[22] Filed: Jun. 26, 1995

[51] Int. Cl.[6] ..... A46B 5/02; A46B 9/02

[52] U.S. Cl. ..... 15/160; 15/104.2; 15/143.1; 15/206; 15/DIG. 5

[58] Field of Search ..... 15/104.16, 104.2, 15/143.1, 159.1, 160, 164, 206, DIG. 5, 167.1; 601/136, 137, 141; D4/128, 131, 134

[56] References Cited

U.S. PATENT DOCUMENTS

| | | | |
|---|---|---|---|
| Re. 17,249 | 3/1929 | Jackson . | |
| D. 358,259 | 5/1995 | Sears | D4/134 |
| 637,328 | 11/1899 | Fanckboner | 15/159.1 |
| 869,250 | 10/1907 | Martin | 601/137 |
| 986,370 | 3/1911 | Douglass . | |
| 2,039,052 | 4/1936 | Beck | 15/160 |
| 2,483,503 | 10/1949 | Pollack | 15/167.1 |
| 2,584,503 | 2/1952 | Schleenbaker . | |
| 2,817,864 | 12/1957 | Morton | 15/160 |
| 3,451,723 | 6/1969 | Marks . | |
| 3,935,611 | 2/1976 | Locher . | |
| 4,184,221 | 1/1980 | Edwards . | |
| 4,754,764 | 7/1988 | Bayne . | |
| 4,819,291 | 4/1989 | Gunjian . | |
| 5,033,155 | 7/1991 | Klotz . | |
| 5,115,530 | 5/1992 | Distiso . | |
| 5,222,272 | 6/1993 | Park | 15/159.1 |

*Primary Examiner*—David Scherbel
*Assistant Examiner*—Randall E. Chin
*Attorney, Agent, or Firm*—Gary M. Hartman; Domenica N. S. Hartman

[57] ABSTRACT

A cleaning brush that is uniquely configured for removing lint, dust and other debris from an arcuate duct, such as an exhaust duct of a clothes dryer. The brush generally includes a body having an elongate arcuate shape, with a radius of curvature that is preferably greater than the length of the body. The body is formed of a flexible material so as to permit the brush to flex in the direction of the radius of curvature, which enables the brush to adapt to variations in the arcuate shapes of ducts. The brush is also provided with bristles that substantially cover one end of the body. The bristles include shorter, tightly-wound inner bristles and longer bristles that surround the inner bristles. As such, the brush is characterized by features that uniquely enable the brush to effectively remove lint and dust from along the entire length of a duct, yet enable the brush to flex sufficiently to accommodate variations in the arcuate shapes of ducts.

10 Claims, 1 Drawing Sheet

LINT BRUSH FOR A DRYER DUCT

BACKGROUND OF INVENTION

1. Field of the Invention

The present invention generally relates to brushes that are uniquely configured for use on arcuate surfaces. More particularly, this invention relates to a lint brush that is specially configured to effectively remove lint, dust and other debris from an arcuate duct, such as an exhaust duct of a clothes dryer.

2. Description of the Prior Art

Brushes adapted for cleaning must at times be specifically configured for the type of surface or object to be cleaned. Like most types of brushes, cleaning brushes generally include some type of handle, a body, and bristles. The bristles are typically selected to provide an effective cleaning action without damaging the surface being cleaned. Furthermore, the body is often formed to be relatively rigid in order to enable an adequate level of force to be applied through the bristles when the brush is held by its handle. For this purpose, the body of a cleaning brush is often formed from a relatively rigid plastic or from multiple wires that have been twisted together in order to promote rigidity.

When the surface or object to be scrubbed is not a flat surface or not readily accessible, a standard straight cleaning brush with a rigid body will often be impractical of effectively cleaning the surface. Therefore, several variations have been suggested in the prior art to improve the cleaning ability of brushes intended for use on an arcuate surface. One such solution is to modify the shape of the brush in order to enable the brush to be used on a curved surface. For example, U.S. Pat. No. Reissue 17,249 to Jackson teaches a brush having a stiff wire core that is bent into a curved shape so as to improve contact with the sides and bottom surface of a bottle. Another example is U.S. Pat. No. 3,935,611 to Locher, which discloses a brush having a curved shape with brushes on multiple surfaces. Because of its arcuate shape, the brush taught by Locher has an improved capacity to engage surfaces that are themselves curved. Furthermore, the shape of Locher's brush can be modified in a limited manner as a result of the brush being composed of two separate parts that can be assembled together in two different configurations. In one configuration, the brush has an S-shaped body, while the brush has a single continuous arcuate shape in the second configuration.

Though the brushes taught by Locher and Jackson are adapted to clean a curved surface, their limited flexibility and bristle configurations render these brushes unsuitable for a variety of contoured surface contours. Accordingly, other forms of brushes suggested by the prior art have been directed toward being adapted to clean diverse irregular surface contours and/or access a surface that is otherwise inaccessible with a stiff brush. For example, U.S. Pat. No. 4,819,291 to Gunjian teaches a brush that has a flexible coil spring inserted within its body so as to enable the brush to be manipulated into a shape necessary for the brush to be fed along a sharply curved surface, such as the interior wall of a curved tube. However, the bristles employed taught by Gunjian cannot be located along the length of the coil spring, and therefore offer only a limited cleaning capability. Furthermore, the bristles are not located at the tip of the brush, such that the end of a tube cannot be effectively cleaned with the brush. Finally, the coil spring has limited resistance to deformation, and therefore prevents the bristles from being applied against a surface with any substantial force. Consequently, the brush taught by Gunjian is substantially limited to applications where only surfaces parallel with the body of the brush require scrubbing, and the scrubbing needed on these surfaces requires only minimal force.

In view of the above, it can be seen that the prior art lacks a brush that is particularly well-suited for cleaning a long arcuate passage. A notable example of such a passage is an exhaust duct of a typical household clothes dryer. The ability to clean a dryer duct is important from the standpoint of reducing the substantial fire hazard posed by the accumulation of lint and dust in the duct, which is known to be a common source of house fires. In addition, a clean exhaust duct is essential for maximizing the efficiency of the dryer. While dryer ducts are provided with a lint screen, lint, dust and other debris invariably collect along the walls of the duct and at the base of the duct, and this debris may have the potential for migrating to the heating element of the dryer. Therefore, it would be desirable to have a brush which is uniquely designed to have a superior ability to clean the arcuate surfaces and base of a dryer duct as well as similarly shaped ducts.

SUMMARY OF THE INVENTION

It is an object of this invention to provide a brush capable of cleaning an arcuate shaped surface, such as the walls and base of an exhaust duct of a clothes dryer.

It is further an object of this invention that such a brush is relatively flexible so as to be adaptable to various arcuate shaped surfaces and not limited to any single particular shape, while still exhibiting sufficient rigidity such that an adequate force can be applied to the brush for thorough cleaning.

Lastly, it is another object of this invention that such a brush is equipped with bristles that promote the ability of the brush to thoroughly clean the surfaces and the base of a long arcuate duct without causing damage to the surfaces being cleansed.

In accordance with a preferred embodiment of this invention, these and other objects and advantages are accomplished as follows.

The present invention generally provides a cleaning brush that is uniquely configured for use on surfaces that are relatively long and arcuate. More particularly, the brush of this invention is adapted to remove lint, dust and other debris from an arcuate duct, such as an exhaust duct of a clothes dryer. For this purpose, the brush is characterized by features that uniquely enable the brush to effectively remove lint and dust from along the entire length of the duct, yet permit the brush to flex sufficiently to accommodate variations in the arcuate shape of such ducts.

The brush of this invention generally includes a body having an elongate arcuate shape with oppositely disposed first and second ends. The brush is further characterized by a length as measured along the arc of the body from the first end to the second end, with the body of the brush being substantially disposed along a radius of curvature that is greater than the length of the body. Furthermore, the body has a thickness in a first direction corresponding to the direction in which the radius of curvature is determined and a width in a second direction transverse to the first direction. The body is preferably formed of a flexible material so as to enable the brush to flex in the first direction, corresponding to the thickness of the body, and thereby conform to variations in the arcuate shapes of ducts. Finally, the brush is also provided with bristles disposed at its second end, some of which extend radially while others extend longitudinally from and relative to the second end. The bristles substantially cover the second end of the body, and are composed of first and second sets of bristles. A tapered handle may be disposed at the first end of the body to facilitate use of the brush.

In a preferred embodiment, the body is more flexible in the first direction, corresponding to its thickness, than in the second direction, corresponding to its width, such that flexibility within the brush is directed primarily to the purpose of contending with variations in the arcuate shape of a duct being cleaned. As such, sufficient rigidity can be achieved in other directions of the brush so as to promote the brush's cleaning capability when moved from side to side. This aspect of the brush is further promoted by forming the body to be tapered such that the width at the first end of the body is greater than the width at the second end of the body.

In order to provide a dual cleaning action, the first set of bristles is preferably longer than the second set of bristles. In addition, the bristles of the first set flex more readily than do those of the second set. The latter feature is advantageous in that the stiffer second set of bristles serves to enhance the cleaning ability of the brush when used in a duct whose arcuate shape differs from that of the brush, in that the stiffer bristles resist a complete collapse of the bristles when forced against the wall of the duct. Finally, bristles preferably extend from the second end of the brush, such that the tip of the body at the second end will be prevented from damaging the wall of the duct, and such that the brush is capable of cleaning the very end or bottom of the duct.

According to the above, an advantageous aspect of this invention is that the brush is particularly well-suited for use on arcuate surfaces and within arcuate ducts, such as the constricted arcuate duct common in most household clothes dryers. The bristles are able to effectively remove lint and dust from the walls and surfaces of such a duct because the brush is capable of sufficiently conforming to the shape of the duct so as to permit the bristles to effectively engage the surfaces without collapsing. Because the body of the brush is relatively more rigid in a direction transverse to its radius of curvature, a user is able to more readily transfer a suitable force through the body of the brush to the bristles in order to maximize the cleaning effect. Finally, the base of a duct can also be cleaned with the brush of this invention due to the presence of bristles extending longitudinally from the end of the brush. Such a capability is particularly important when attempting to thoroughly clean the bottom of a dryer duct.

In the above manner, the brush of this invention is able to increase the efficiency of a household clothes dryer by removing lint, dust and other debris that otherwise restrict the flow of air through its exhaust duct. Adequate removal of lint along the walls and base of the duct promotes air flow, thereby increasing the efficiency of the dryer by enabling it to dry its contents quicker than otherwise possible. In addition, use of the brush of this invention increases the operating safety of the dryer by reducing the chance of lint and dust becoming ignited by direct exposure to the heating element or source of a dryer, including a gas pilot light or electronic igniter.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE PREFERRED EMBODIMENT

Figure 1:
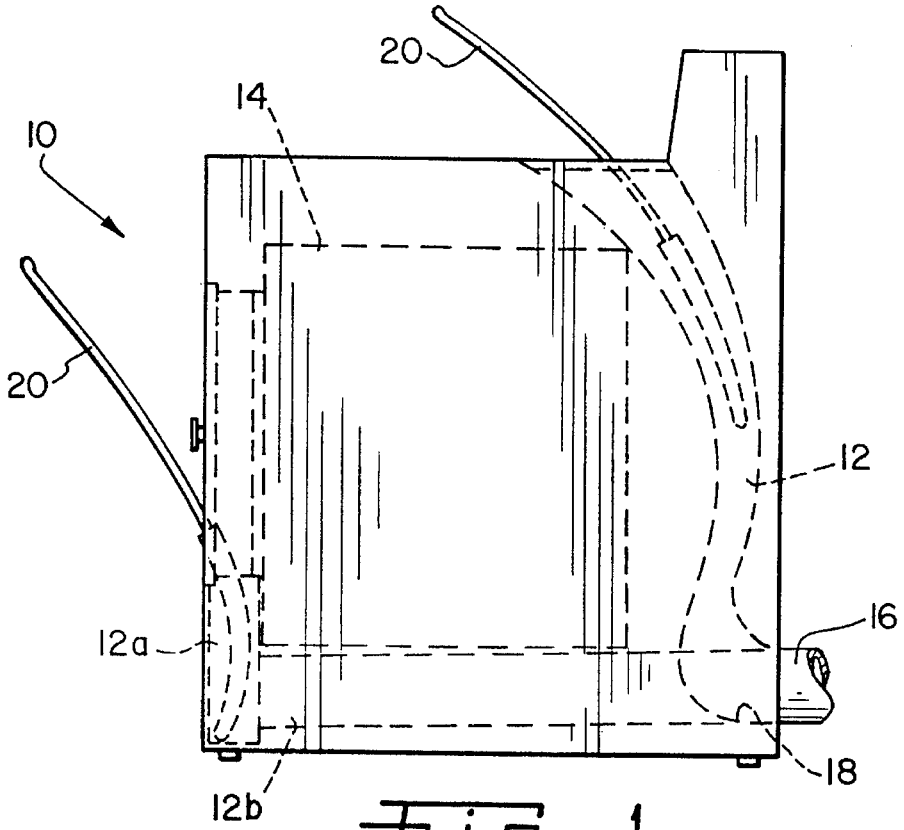
FIG. 1 is a side cross-sectional view of a household clothes dryer in the process of being cleaned with a lint brush configured in accordance with a preferred embodiment of this invention.

FIG. 1 represents in cross-section a clothes dryer 10 of the type used in households and commercial settings. As shown, the dryer 10 includes an exhaust duct 12 through which damp heated air leaves the interior drum 14 of the dryer 10 and exits through an outlet 16 located at the base of the dryer 10. For purposes of illustration, a second duct **12*a* is shown in FIG. 1 that depicts another duct configuration known for clothes dryers. This duct 12*a* requires an additional duct 12*b* that directs the flow of air to the outlet 16 of the dryer 10. While the duct 12 is of particular interest due to its relatively inaccessible passage that renders the duct 12 extremely hard to clean, it is apparent from FIG. 1 that portions of the duct 12*a* can be equally difficult to clean, particularly the corners of the duct 12*a*. While a lint screen (not shown) is used in both types of ducts for the purpose of trapping lint entrained in the exhaust air, lint invariably clings to the walls of the ducts 12 and 12*a* and accumulates at the base 18 of the duct 12 below the screen. According to this invention, a lint brush 20 is provided that is uniquely adapted to remove lint, dust and similar debris from the walls and base of an arcuate passage typified by the duct 12, as well as shorter passages typified by the duct 12*a***.

Figure 2:
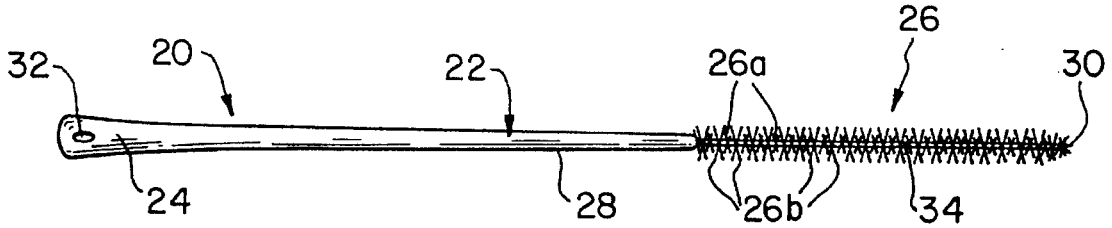
FIGS. 2 and 3 are plan and side views of the lint brush of FIG. 1.
Figure 3:
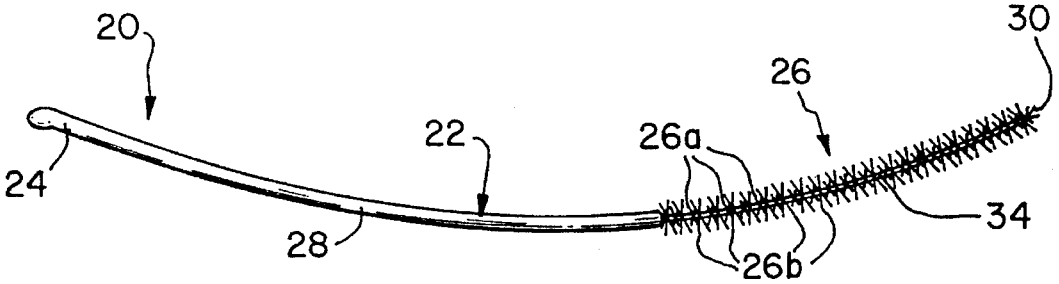

The brush 20 shown in FIGS. 2 and 3 is generally composed of a body 22 having oppositely disposed ends, with a handle 24 formed at one end, a bristle portion 26 disposed at the other end, and a shank 28 therebetween. The handle 24 is preferably equipped with a hole 32 or other suitable feature that enables the brush 20 to be suspended during storage. The body 22 of the brush 20 is formed to have a uniform arcuate shape, similar to that of the duct 12 shown in FIG. 1. Preferably, the body 22 is substantially disposed along a uniform radius of curvature, as is most readily apparent in FIG. 3. In order to enable the brush 20 to traverse the length of the duct 12, the radius of curvature of the body 22 is greater than the length of the body 22, as measured along the arc of the body 22. While optimal dimensions for the brush 20 may vary, depending upon the particular shape of the duct or passage to be cleaned, a useful length for the brush 20 is about 50 to about 75 centimeters (about 20 to about 30 inches), with a suitable radius of curvature being about 75 to about 125 centimeters (about 30 to about 50 inches).

The body 22 of the brush 20 is constructed of a flexible material, and preferably a flexible plastic material, so that the body 22 is able to readily conform to the arcuate shape of the duct 12, even if a minor discrepancy exists in their radii of curvature. While flexibility is essential for enabling the brush 20 to apply a uniform pressure through the bristle portion 26 along the entire length of the duct 12, excessive flexibility is undesirable from the standpoint of enabling a sufficient force to be applied to the walls near the base 18 of the duct 12. For this purpose, the body 22 preferably exhibits a degree of rigidity, with the body 22 preferably exhibiting greater rigidity near the handle 24 than at the bristle portion 26.

To achieve this aspect and yet maintain flexibility along the entire length of the body 22 for the purpose of conforming to the arcuate shape of the duct 12, the body 22 preferably has the tapered shape shown in FIG. 2. Seen in FIG. 2 is the width of the body 22, which is transverse to the thickness of the body 22 shown in FIG. 3. As such, the thickness of the body 22 is in the direction of the radius of curvature of the body 22. FIG. 2 illustrates the tapered appearance of the body 22, with the width of the body 22 being greater at the handle 24 than at the bristle portion 26. For example, a suitable width for the body 22 at the handle 24 is about two centimeters (about ¾ inch), while a suitable width along the shank 28 is about one centimeter (about ⅜ inch). Accordingly, the brush 20 is relatively more rigid at its end corresponding to the handle 24 than at its opposite end corresponding to the bristle portion 26. Yet as shown in FIG. 3, the thickness of the brush 20 is generally uniform in order to enable the brush 20 to negotiate and conform to the full length of the duct 12, even if a discrepancy exists between the arcuate shape of the brush 20 and the arcuate shape of the duct 12. In this manner, the body 22 may preferably exhibit a greater flexibility in the direction of its thickness than in the direction of its width (i.e., the direction corresponding to the direction in which the radius of curvature is determined for the body 22). For example, the thickness of the body 22 is preferably less than the width of the body 22 at the handle 24, as shown in FIG. 3, and may be less than the width of the body 22 at the shank 28.

The bristle portion 26 is shown as being composed of numerous bristles extending radially and longitudinally from and relative to a braided wire 34 that is in-molded or otherwise attached to the shank 28 of the brush 20. Alternatively, the bristles could be in-molded or otherwise directly attached to the body 22 of the brush 20. According to a preferred embodiment of this invention, the bristle portion 26 has a diameter (defined by diametrically opposing tips of the bristles) of about ten to fifteen millimeters (about ½ inch) and covers approximately the last twenty to twenty-five centimeters (about nine inches) of the end of the body 22, including the tip 30 of the body 22. The bristles are preferably of two different lengths, each of which are preferably formed of wire-reinforced nylon having a preferred diameter of about 0.2 millimeter (about 0.008 inch). The bristle portion 26 includes an inner core of shorter, tightly-wound bristles **26*a* having a length of about 1 to about 3 millimeters, and a number of longer bristles 26*b* having a length of about 4 to about 4.5 millimeters, which circumferentially surround the shorter bristles 26*a*. As such, the shorter bristles 26*a* offer more rigid resistance to deflection than do the longer bristles 26*b*, and the longer bristles 26*b* are more prone than are the shorter bristles 26*a* to being collapsed when forced against the wall of the duct 12. As a result, the shorter bristles 26*a* tend to space the body 22 of the brush 20 away from the surface being cleaned, and therefore promote the cleaning capability of the brush 20. Furthermore, the bristles extending longitudinally from the tip 30 of the brush 20 prevent the tip 30 from contacting the surface being cleaned, enabling the brush 20 to clean the base 18 of the duct 12 shown in FIG. 1, while also preventing the tip 30 from damaging the walls of the duct 12**.

In accordance with above, a user of the brush 20 of this invention is readily able to clean an arcuate-shaped passage, such as the dryer ducts 12 and **12*a*, by working the bristle portion 26 against the interior walls of the ducts 12 and 12*a* with the bristles 26*a* and 26*b*. The user can perform the cleaning motion easily by holding on to the handle 24, which is advantageously flared as a result of the taper along the length of the body 22. The brush 20 is well-suited for cleaning the entire length of the long, arcuate dryer duct 12 as well as the difficult-to-reach regions of the shorter duct 12*a*, as shown in FIG. 1**.

From the above, it can be seen that an advantageous aspect of this invention is that the brush 20 is particularly well-suited for use on arcuate surfaces and within arcuate ducts, such as the constricted arcuate duct common in most household clothes dryers. The bristles **26*a* and 26*b* are able to effectively remove lint and dust from the walls and surfaces of such a duct because the brush 20 is capable of sufficiently conforming to the shape of the duct, which permits the bristles 26*a* and 26*b* to effectively engage the surfaces without collapsing. Because the body 22 of the brush 20 is relatively more rigid in a direction transverse to its radius of curvature, a user is able to more readily transfer a suitable force through the body 22 of the brush 20 to the bristles 26*a* and 26*b* in order to maximize the cleaning effect. Finally, the base of a duct can also be cleaned with the brush 20 of this invention due to the presence of bristles 26*a* and 26*b* extending longitudinally from the tip 30 of the brush 20. Such a capability is particularly important when attempting to thoroughly clean the base 18 of the dryer duct 12 shown in FIG. 1**.

Accordingly, a benefit of using the brush 20 of this invention is that the efficiency of a household clothes dryer can be increased by removing lint, dust and other debris that inherently collect in its exhaust duct and restricts the flow of air through the duct. Adequate removal of lint along the walls and base of the duct promotes air flow, thereby increasing the efficiency of the dryer by enabling it to dry its contents quicker than otherwise possible. In addition, use of the brush 20 of this invention increases the safety of the dryer by reducing the chance of accumulated lint and dust becoming ignited by direct exposure to the heating element or heat source of a dryer, including a gas pilot light or electronic igniter.

While our invention has been described in terms of a preferred embodiment, it is apparent that other forms could be adopted by one skilled in the art. For example, the overall appearance, construction or dimensions of the lint brush could differ from that shown, or appropriate materials could be substituted for those noted. Accordingly, the scope of our invention is to be limited only by the following claims.

The embodiments of the invention in which an exclusive property or privilege is claimed are defined as follows:

1. A lint brush for removing lint and other debris from a duct, the lint brush comprising:

a body having an elongate arcuate shape adapted for cleaning an elongate arcuate duct, the body having a first end, a longitudinally-opposed second end, a longitudinal length as measured along the body from the first end to the second end, and a radius of curvature that is greater than the length of the body, the elongate arcuate shape of the body being substantially uniform along the length of the body, the body having a thickness in a first direction corresponding to the direction in which the radius of curvature is determined and a width in a second direction transverse to the first direction, the body being formed of a flexible material so as to be flexible along the entire length of the body, such that the brush is able to flex in the first direction and thereby conform to a variation in the arcuate shape of the elongate arcuate duct, the body being more flexible in the first direction than in the second direction; and bristles extending radially and longitudinally from and relative to the second end of the body, the bristles substantially and uniformly covering the second end of the body.

2. A lint brush as recited in claim, 1 wherein the body further comprises a handle disposed at the first end of the body.

3. A lint brush as recited in claim 2 wherein the handle is tapered so as to be wider at the first end of the body.

4. A lint brush as recited in claim 1 wherein the body is tapered such that the width at the first end of the body is greater than the width at the second end of the body.

5. A lint brush as recited in claim 1 wherein the body further comprises a handle formed on the body and means for suspending the body disposed at the handle.

6. A lint brush as recited in claim 1 wherein the body is formed of plastic.

7. A lint brush as recited in claim 1 wherein the bristles comprise longer bristles and shorter bristles, the longer bristles flexing more readily than the shorter bristles.

8. A lint brush as recited in claim 1 wherein the bristles are formed of wire-reinforced nylon.

9. A lint brush as recited in claim 1 wherein the thickness of the body is less than the width at the first end of the body.

10. A lint brush for removing lint and other debris from an exhaust duct of a clothes dryer, the lint brush comprising:

a body having an elongate arcuate shape adapted for cleaning an elongate arcuate duct, the body having a first end, a longitudinally-opposed second end, a longitudinal length as measured along the body from the first end to the second end of about 50 to about 75 centimeters, and a radius of curvature that is greater than the length of the body, the elongate arcuate shape of the body being substantially uniform along the length of the body, the body having a thickness in a first direction corresponding to the direction in which the radius of curvature is determined and a width in a second direction transverse to the first direction, the body being tapered such that the width at the first end of the body is greater than the width at the second end of the body, the body being formed of a flexible plastic material so as to be flexible along the entire length of the body, such that the brush is able to flex in the first direction and thereby conform to a variation in the arcuate shape of the elongate arcuate duct, the body being more flexible in the first direction than in the second direction;

a handle disposed at the first end of the body; and bristles extending radially and longitudinally from and relative to the second end of the body, the bristles being substantially and uniformly distributed to cover the second end of the body, diametrically-opposing tips of the bristles defining an effective diameter of about ten to about fifteen millimeters.

* * * * *